US011255510B2

(12) United States Patent
Lin et al.

(10) Patent No.: US 11,255,510 B2
(45) Date of Patent: Feb. 22, 2022

(54) DECORATIVE BULB WITH INNER LENS

(71) Applicant: ZHANGZHOU GO WIN LIGHTING CO., LTD, Zhangzhou (CN)

(72) Inventors: Xiongzhong Lin, Zhangzhou (CN); Yao Liu, Zhangzhou (CN)

(73) Assignee: ZHANGZHOU GO WIN LIGHTING CO., LTD, Zhangzhou (CN)

( * ) Notice: Subject to any disclaimer, the term of this patent is extended or adjusted under 35 U.S.C. 154(b) by 0 days.

(21) Appl. No.: 17/020,863

(22) Filed: Sep. 15, 2020

(65) Prior Publication Data

US 2022/0026040 A1 Jan. 27, 2022

(30) Foreign Application Priority Data

Jul. 22, 2020 (CN) ..... 202021465247.8

(51) Int. Cl.

| | |
|---|---|
| ***F21V 5/00*** | (2018.01) |
| ***F21V 3/02*** | (2006.01) |
| ***F21K 9/232*** | (2016.01) |
| ***F21K 9/23*** | (2016.01) |
| ***F21V 31/00*** | (2006.01) |
| ***F21V 23/06*** | (2006.01) |

(52) U.S. Cl.

CPC ..... *F21V 5/00* (2013.01); *F21K 9/23* (2016.08); *F21K 9/232* (2016.08); *F21V 3/02* (2013.01); *F21V 23/06* (2013.01); *F21V 31/005* (2013.01)

(58) Field of Classification Search

CPC ... F21K 9/232; F21V 5/04; F21V 5/00; F21V 3/02; F21V 23/06; F21V 31/005

See application file for complete search history.

(56) References Cited

U.S. PATENT DOCUMENTS

| | | | | |
|---|---|---|---|---|
| 7,329,029 | B2 * | 2/2008 | Chaves | G02B 3/06 257/E33.071 |
| 8,948,564 | B1 * | 2/2015 | Sherman | F21K 9/232 385/146 |
| 9,494,297 | B1 * | 11/2016 | Nagengast | F21V 13/04 |
| 2003/0107894 | A1 * | 6/2003 | Mize | H01L 33/54 362/296.01 |
| 2006/0034077 | A1 * | 2/2006 | Chang | F21V 3/02 362/227 |
| 2007/0153518 | A1 * | 7/2007 | Chen | F21V 23/00 362/249.01 |
| 2009/0067179 | A1 * | 3/2009 | Chaves | F21K 9/64 362/329 |
| 2012/0106153 | A1 * | 5/2012 | Huang | F21K 9/232 362/249.02 |

(Continued)

FOREIGN PATENT DOCUMENTS

CN 205690127 * 11/2016 ..... F21K 9/232

*Primary Examiner* — Fatima N Farokhrooz

(57) ABSTRACT

A decorative bulb with inner lens includes a mounting base; a light bulb covering mounted on the mounting base; an optical lens, comprising a mounting part and a lens part integrally formed with the mounting part, the lens part is a semi-ellipsoid structure, and the lens part is provided with a light refraction strengthening part on an outer surface of the lens part, the light refraction strengthening part extends from a top of the lens part along the outer surface of the lens part to a bottom of the lens part, and a cross section of the light refraction strengthening part is in a shape of annular wave; a light unit mounted in the cone-shaped cavity.

10 Claims, 7 Drawing Sheets

(56) References Cited

U.S. PATENT DOCUMENTS

| | | | | |
|---|---|---|---|---|
| 2014/0268802 | A1* | 9/2014 | Sun | F21V 29/83 362/294 |
| 2015/0062909 | A1* | 3/2015 | Progl | F21K 9/232 362/294 |
| 2016/0273716 | A1* | 9/2016 | Tarsa | G02B 6/0001 |
| 2018/0328544 | A1* | 11/2018 | Rieder | F21K 9/232 |

* cited by examiner

DECORATIVE BULB WITH INNER LENS

CROSS REFERENCE TO RELATED APPLICATIONS

This application claims all benefits accruing under 35 U.S.C. § 119 from China Patent Application No. 202021465247.8 filed on Jul. 22, 2020, in the State Intellectual Property Office of China, the disclosure of which is incorporated herein by reference in its entirety.

TECHNICAL FIELD

The disclosure generally relates to the field of decorative bulb, and more particularly to a decorative bulb with an inner lens.

BACKGROUND

Decorative bulbs are very suitable for decorative purposes because of their rich colors, small size, durability and energy savings. They can be installed on a circuit board or flexible cable or other materials, and can be used as a light source for letter lights, sign boards, track lights, tubes, etc.

Decorative bulbs have various shapes, and a pointed-bulb-shaped decorative bulb is a common shape. The luminous plate of the pointed-bulb-shaped decorative bulb is arranged at its bottom, and light of the luminous plate is uniformly emitted along the outer surface, but an amount of light of the pointed-bulb-shaped light bulb covering is different. Therefore, when human eyes look at the pointed-bulb-shaped light bulb covering from the outside, the brightness of the outer surface of the decorative bulb is uneven. As shown in FIG. 1, the upper and lower parts appear bright, and there are multiple dark bars in the middle part, giving people a visual effect with dark parts in the middle.

The purpose of this disclosure is to design a decorative bulb with an inner lens for the above existing technical problems.

SUMMARY OF DISCLOSURE

In view of the problems existing in the prior art, the disclosure provides a decorative bulb with an inner lens, and can effectively solve the problems existing in the prior art.

The technical scheme of the disclosure is:

A decorative bulb with an inner lens, comprising:

a mounting base having external thread;

a light bulb covering mounted on the mounting base, the light bulb covering provided with a light bulb covering cavity along an axis of the light bulb covering;

an optical lens comprising a mounting part installed in the mounting base and a lens part integrally formed with the mounting part, the lens part is a semi-ellipsoid structure, and a long axis of the lens part coincides with the axis of the light bulb covering, and the lens part is provided with a cone-shaped cavity inside, and the lens part is provided with a light refraction strengthening part on an outer surface of the lens part, the light refraction strengthening part extends from a top of the lens part along the outer surface of the lens part to a bottom of the lens part, and a cross section of the light refraction strengthening part is in a shape of annular wave, an angle between a crest of the shape of annular wave and a trough of the shape of annular wave adjacent the crest A decreases successively along a bottom of the lens part to a top of the lens part, a wave height of the shape of annular wave becomes larger and then smaller along a bottom of the lens part to a top of the lens part; a light unit mounted in the cone-shaped cavity.

Further, the light bulb covering comprises a first arc-shaped cover and a second arc-shaped cover in an axial sequence away from the mounting base, and a radius of the first arc-shaped cover increases in a direction away from the mounting base, and a radius of the second arc-shaped cover decreases in a direction away from the mounting base; and a length of the second arc-shaped cover in a direction of the axial is longer than a length of the first arc-shaped cover in a direction of the axial direction.

Further, the light bulb covering cavity is connected to the light unit, and an upper part of the light bulb covering cavity is a conical structure, a lower part of the light bulb covering cavity is a cylindrical structure, and a transparent or translucent filling layer is filled between the outer surface of the light bulb covering and the light bulb covering cavity.

Further, the light unit comprises a light board, and the light board is connected in tandem with a current limiting resistor.

Further, the light unit is connected in tandem with rectifier circuit.

The decorative bulb further comprises a waterproof silicone pad mounted inside the mounting base.

Further, a connection between the light bulb covering and the mounting base is provided with a sealing ring.

Further, the outer surface of the light bulb covering is provided with a plurality of square cone-shaped inner concaves, and an area of a bottom surface of the square-shaped inner concave decreases from a bottom of the light bulb covering to a top of the light bulb covering.

Further, a number of the crest of the shape of annular wave is 10-18.

Further, a height of the light bulb covering is defined as D1, a height of the lens part is defined as D2, D1:D2=3-4.

The technical scheme has the following technical effects:

1) When lighting, through the sharp pointed-bulb shape of the light bulb covering and a light bulb covering cavity inside, the upper part of the light bulb covering cavity is a conical structure, the lower part of the light bulb covering cavity is a cylindrical structure, and the optical lens is provided with between the light bulb covering and the light unit, and the cone-shaped cavity is provided with inside the optical lens, the lens part is provided with a light refraction strengthening part on the outer surface of the lens part. Through the cooperation of the above parts of the structure, the technical effect of uniform brightness of the light bulb covering viewed from all angles is obtained, and a better overall vision is obtained.
2) The light emitted by the light unit is refracted for the first time when entering the lens part through the lens cavity. After passing through the light refraction strengthening part, the direction of the light is changed again, the direction of the light changes as follows: the light is concentrated to the crest of the shape of annular wave, and the light is scattered towards the side surface of the light bulb covering. Then, the light is refracted again when it passes through the light bulb covering cavity and the filling layer. Finally, the light is projected to the inner wall of the light bulb covering to form a uniform luminous technical effect.

DETAILED DESCRIPTION

To facilitate the understanding of those skilled in the art, the structure of the disclosure is further described in detail in connection with the accompanying drawings:

Embodiment 1

Figure 1:
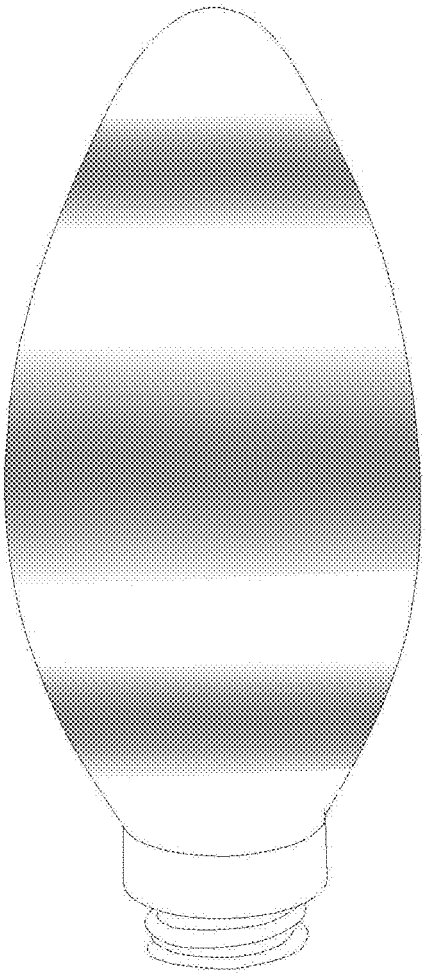
FIG. 1 is a luminous state diagram of a traditional decorative bulb.
Figure 2:
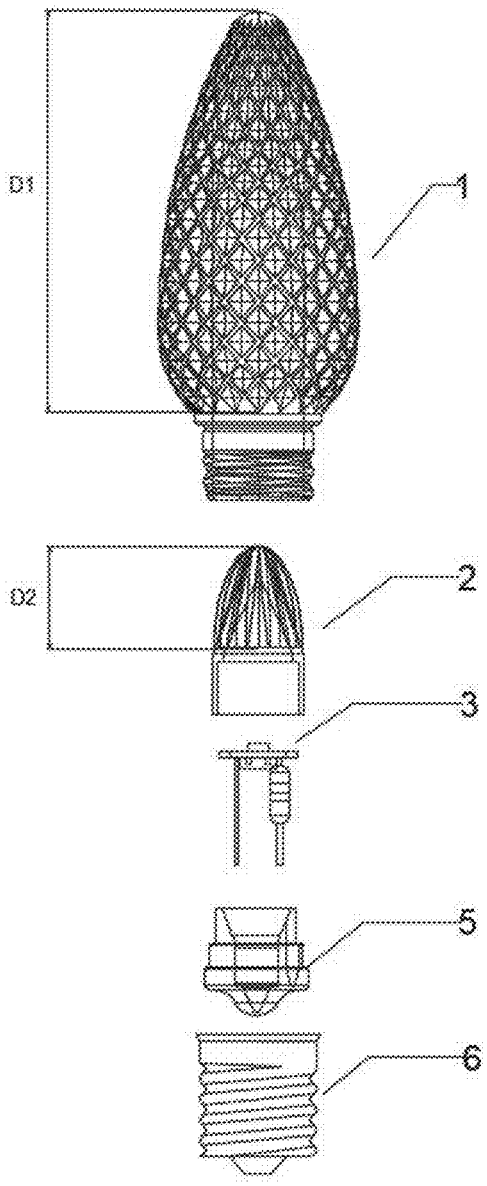
FIG. 2 is an exploded diagram of a structure of Embodiment 1.
Figure 3:
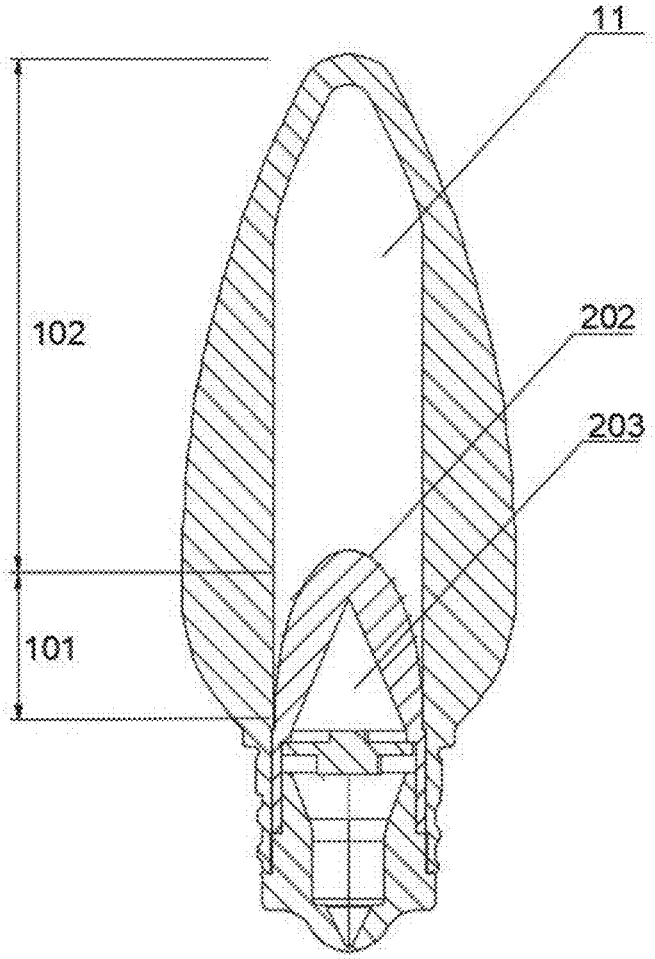
FIG. 3 is an assembly diagram of a structure of Embodiment 1.
Figure 4:
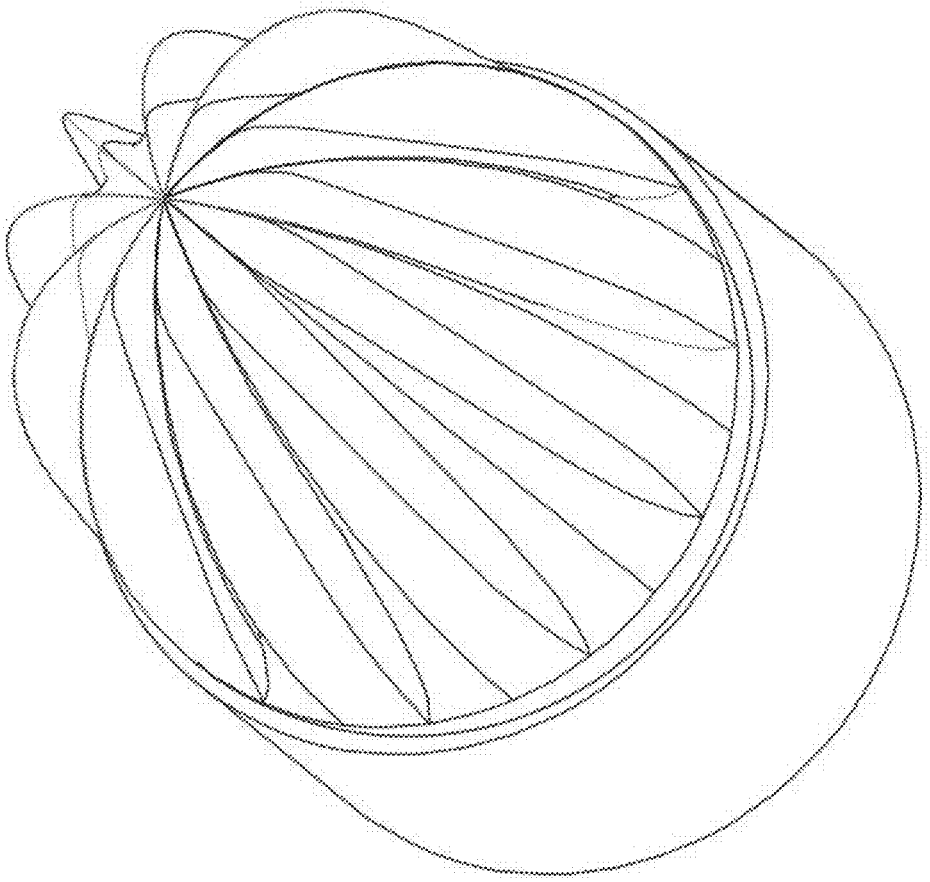
FIG. 4 is a diagram of a structure of an optical lens.
Figure 5:
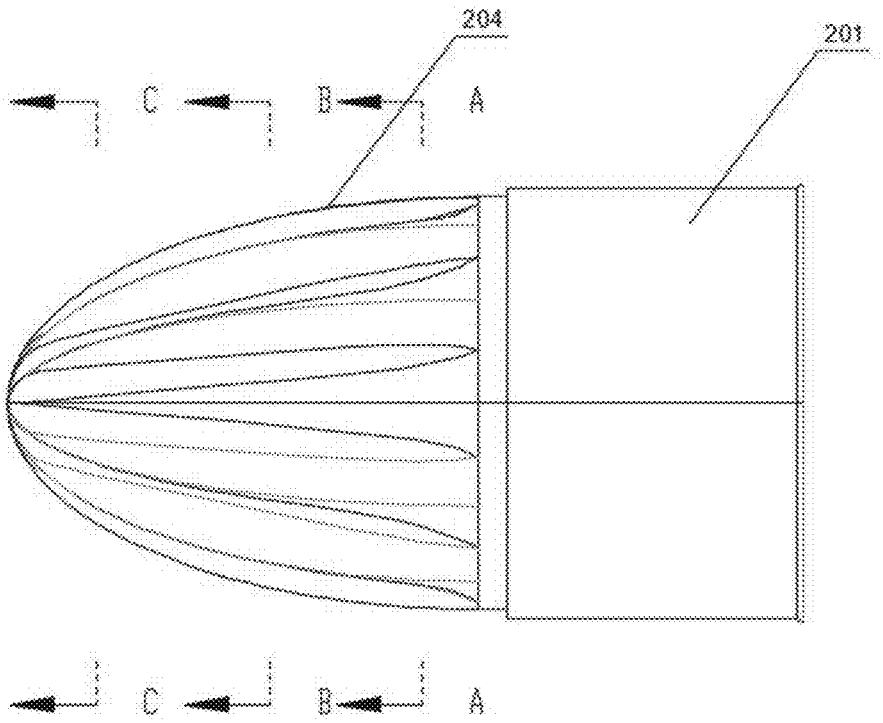
FIG. 5 is a diagram of a structure of an optical lens.
Figure 6:
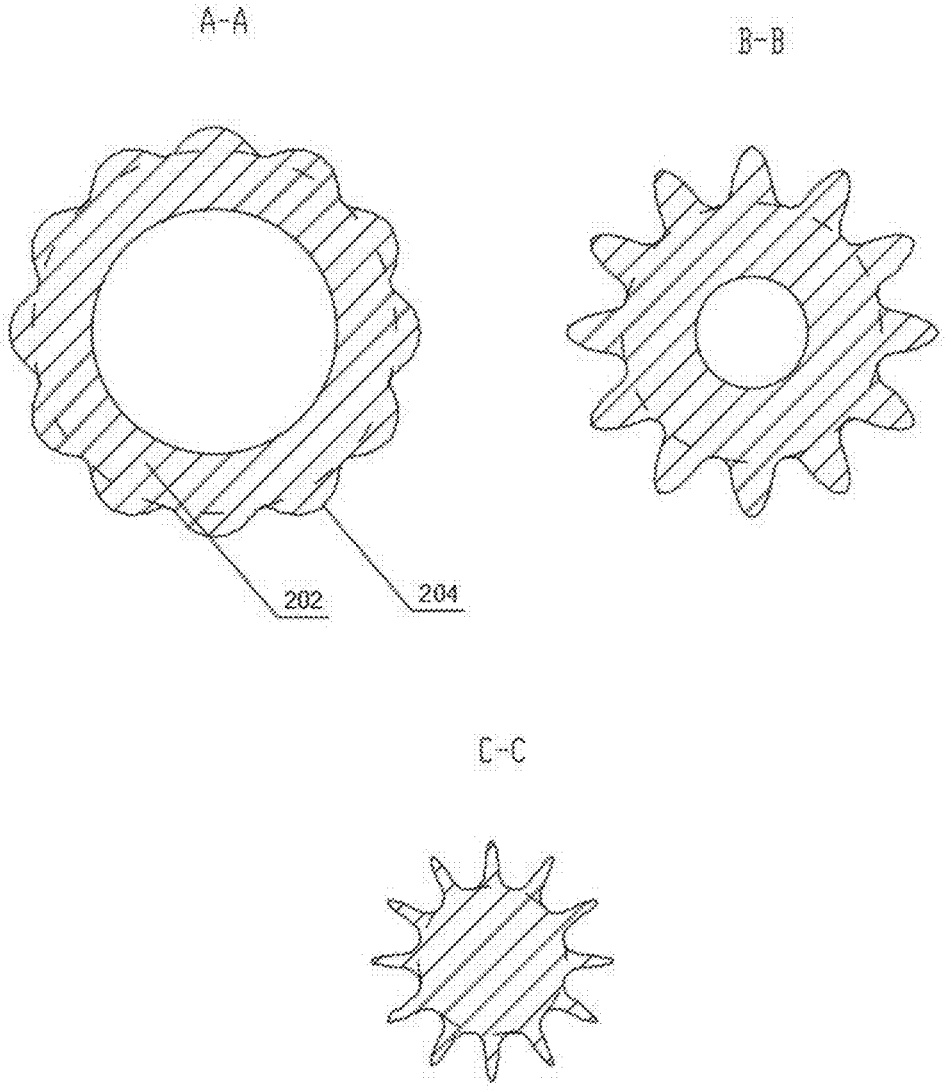
FIG. 6 is cross-sectional views of A-A and B-B and C-C of FIG. 5.
Figure 7:
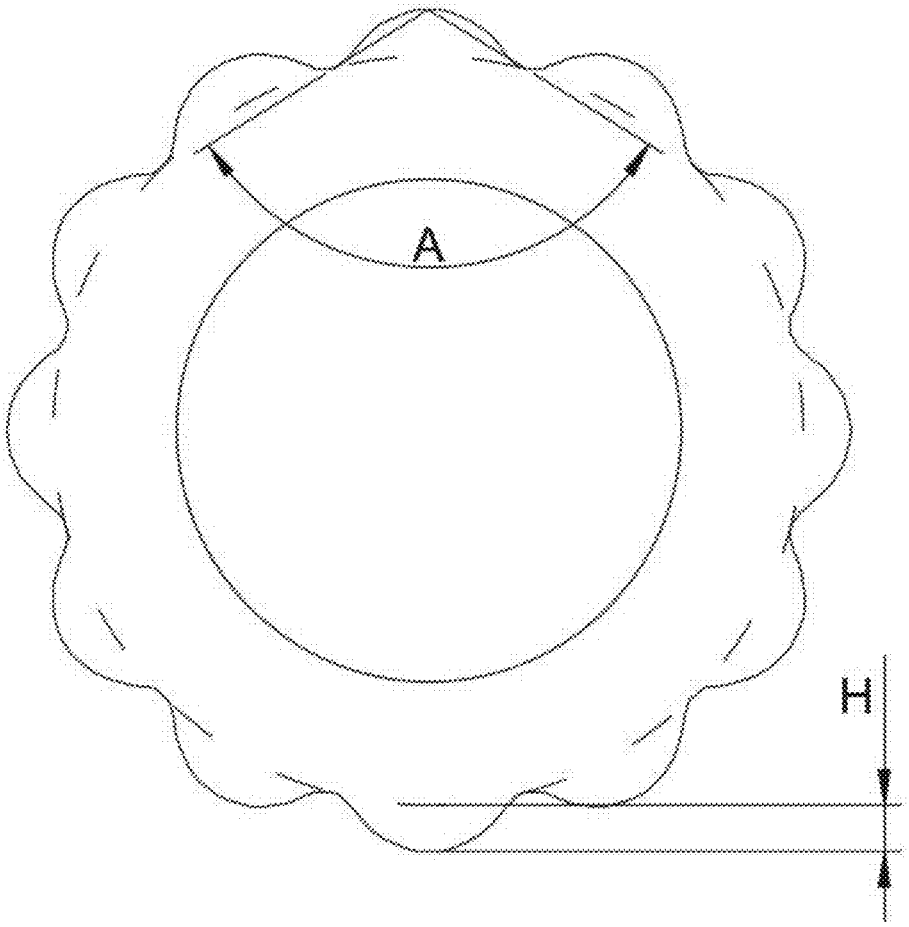
FIG. 7 is a diagram of angle A and height H of a shape of annular wave.

One embodiment of the disclosure, referring to FIG. 2-7.

A decorative bulb with an inner lens, comprising:

a mounting base 6 having external thread;

a light bulb covering 1 mounted on the mounting base 6, the light bulb covering 1 provided with a light bulb covering cavity 11 along an axis of the light bulb covering 1:

an optical lens 2 comprising a mounting part 201 installed in the mounting base 6 and a lens part 202 integrally formed with the mounting part 201, the lens part 202 is a semi-ellipsoid structure, and a long axis of the lens part 202 coincides with the axis of the light bulb covering 1, and the lens part 202 is provided with a cone-shaped cavity 203 inside, and the lens part 202 is provided with a light refraction strengthening part 204 on an outer surface of the lens part 202, the light refraction strengthening part 204 extends from a top of the lens part 202 along the outer surface of the lens part 202 to a bottom of the lens part 202, and a cross section of the light refraction strengthening part 204 is in a shape of annular wave, an angle between a crest of the shape of annular wave and a trough of the shape of annular wave adjacent the crest is defined as A, A decreases successively along a bottom of the lens part 202 to a top of the lens part 202, a wave height of the shape of annular wave is defined as H, H becomes larger and then smaller along a bottom of the lens part 202 to the top of the lens part 202;

a light unit 3 mounted in the cone-shaped cavity 203.

Specifically, wherein the light bulb covering 1 comprises a first arc-shaped cover 101 and a second arc-shaped cover 102 in an axial sequence away from the mounting base 6, and a radius of the first arc-shaped cover 101 increases in a direction away from the mounting base 6, and a radius of the second arc-shaped cover 102 decreases in a direction away from the mounting base 6; and a length of the second arc-shaped cover 102 in a direction of the axial is longer than a length of the first arc-shaped 101 cover in a direction of the axial direction.

Specifically, wherein the light bulb covering cavity 11 is connected to the light unit 3, and an upper part of the light bulb covering cavity 11 is a conical structure, a lower part of the light bulb covering cavity 11 is a cylindrical structure, and a transparent or translucent filling layer is filled between the outer surface of the light bulb covering 1 and the light bulb covering cavity 11.

Specifically, wherein the light unit 3 comprises a light board, and the light board is connected in tandem with a current limiting resistor. The light unit 3 is connected in tandem with rectifier circuit. The rectifier circuit is used to step down the mains, and the current limiting resistor is used to limit voltage. The rectifier circuit and the current limiting resistor belong to current technology and will not be described in detail here.

Specifically, wherein the decorative bulb further comprises a waterproof silicone pad 5 mounted inside the mounting base 6.

Specifically, wherein a connection between the light bulb covering 1 and the mounting base 6 is provided with a sealing ring.

Specifically, wherein the outer surface of the light bulb covering 1 is provided with a plurality of square cone-shaped inner concaves, and an area of a bottom surface of the square-shaped inner concave decreases from a bottom of the light bulb covering to a top of the light bulb covering. The function of the square cone-shaped inner concaves is to refract the light and produce a crystal clear effect.

Specifically, wherein a number of the crest of the shape of annular wave is 10-18. In this embodiment, the number of the crest of the shape of annular wave is 12. In other embodiments, the number of the crest of the shape of annular wave can be 10 or 14 or 16 or 18.

Specifically, wherein a height of the light bulb covering 1 is defined as D1, a height of the lens part 202 is defined as D2, D1:D2=3-4. In this embodiment, D1:D2=4. In other embodiments, D1:D2 can be 3 or 3.5.

When lighting, through a sharp pointed-bulb shaped of the light bulb covering 1 and a light bulb covering cavity 11 inside, the upper part of the light bulb covering cavity 11 is a conical structure, the lower part of the light bulb covering cavity 11 is a cylindrical structure, and the optical lens 2 is provided with between the light bulb covering 1 and the light unit 3, and the cone-shaped cavity 203 is provided with inside the optical lens 2, the lens part 202 is provided with a light refraction strengthening part 204 on the outer surface of the lens part 202. Through the cooperation of the above parts of the structure, the technical effect of uniform brightness of the light bulb covering 1 viewed from all angles is obtained, and a better overall vision is obtained.

Working principle: the light emitted by the light unit 3 is refracted for the first time when entering the lens part 202 through the lens cavity 203. After passing through the light refraction strengthening part 204, the direction of the light is changed again, the direction of the light changes as follows: the light is concentrated to the crest of the shape of annular wave, and the light is scattered towards the side surface of the light bulb covering 1. Then, the light is refracted again when it passes through the light bulb covering cavity 11 and the filling layer. Finally, the light is projected to the inner wall of the light bulb covering 1 to form a uniform luminous technical effect.

The foregoing description is only a preferred embodiment of the disclosure, and all changes and modifications to the patent scope applied for in accordance with the disclosure shall belong to the scope covered by the disclosure.

What is claimed is:

1. A decorative bulb with inner lens, comprising:

a mounting base having external thread;

a light bulb covering mounted on the mounting base, the light bulb covering provided with a light bulb covering cavity along an axis of the light bulb covering;

an optical lens comprising a mounting part installed in the mounting base and a lens part integrally formed with the mounting part, the lens part is a semi-ellipsoid structure, and a long axis of the lens part coincides with the axis of the light bulb covering, and the lens part is provided with only one cone-shaped cavity inside, a long axis of the cone-shaped cavity coincides with the axis of the light bulb covering, a diameter of the cone-shaped cavity decreases along a direction away from the mounting base, and the lens part is provided with a light refraction strengthening part on an outer surface of the lens part, the light refraction strengthening part radiating outward extends from a top of the lens part along the outer surface of the lens part to a bottom of the lens part, and a transverse cross section of the light refraction strengthening part is in an annular shape with a wavy outer circumference, an angle between a line connecting a crest of a wave of the wavy outer circumference and a first trough of the wave and a line connecting the crest of the wave and a second trough of the wave is defined as an angle A, a vertical distance from the crest of the wave to the annular shape is defined as a height H, the angles A of a plurality of transverse cross sections of the light refraction strengthening part decrease successively along a direction from a bottom of the lens part to a top of the lens part, and the heights H of the plurality of transverse cross sections of the light refraction strengthening part become larger and then smaller along the direction from the bottom of the lens part to the top of the lens part; a light unit mounted in the cone-shaped cavity.

2. The decorative bulb with inner lens according to claim 1, wherein the light bulb covering comprises a first arc-shaped cover and a second arc-shaped cover in an axial sequence away from the mounting base, and a radius of the first arc-shaped cover increases in a direction away from the mounting base, and a radius of the second arc-shaped cover decreases in a direction away from the mounting base; and a length of the second arc-shaped cover in a direction of the axial is longer than a length of the first arc-shaped cover in a direction of the axial direction.

3. The decorative bulb with inner lens according to claim 1, wherein the light bulb covering cavity is connected to the light unit, and an upper part of the light bulb covering cavity is a conical structure, a lower part of the light bulb covering cavity is a cylindrical structure, and a transparent or translucent filling layer is filled between the outer surface of the light bulb covering and the light bulb covering cavity.

4. The decorative bulb with inner lens according to claim 1, wherein the light unit comprises a light board, and the light board is connected in tandem with a current limiting resistor.

5. The decorative bulb with inner lens according to claim 1, wherein the decorative bulb further comprises a waterproof silicone pad mounted inside the mounting base.

6. The decorative bulb with inner lens according to claim 1, wherein a connection between the light bulb covering and the mounting base is provided with a sealing ring.

7. The decorative bulb with inner lens according to claim 1, wherein the outer surface of the light bulb covering is provided with a plurality of square cone-shaped inner concaves, and an area of a bottom surface of the square-shaped inner concave decreases from a bottom of the light bulb covering to a top of the light bulb covering.

8. The decorative bulb with inner lens according to claim 1, wherein a number of the crest of the shape of annular wave is 10-18.

9. The decorative bulb with inner lens according to claim 1, wherein a height of the light bulb covering is defined as D1, a height of the lens part is defined as D2, D1:D2=3-4.

10. The decorative bulb with inner lens according to claim 4, wherein the light unit is connected in tandem with rectifier circuit.

* * * * *